US010400730B2

(12) United States Patent
Leroux et al.

(10) Patent No.: US 10,400,730 B2
(45) Date of Patent: Sep. 3, 2019

(54) FUEL INJECTOR HAVING EXTERNAL SETTING OF THE COIL SPRING

(71) Applicant: Delphi International Operations Luxembourg, S.A.R.L., Bascharage (LU)

(72) Inventors: Ludovic Leroux, Monthou-sur-Bièvre (FR); Thierry Thibault, Saint Ouen les Vignes (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 27 days.

(21) Appl. No.: 15/743,065

(22) PCT Filed: Jun. 29, 2016

(86) PCT No.: PCT/EP2016/065206
§ 371 (c)(1),
(2) Date: Jan. 9, 2018

(87) PCT Pub. No.: WO2017/005581
PCT Pub. Date: Jan. 12, 2017

(65) Prior Publication Data

US 2018/0202406 A1 Jul. 19, 2018

(30) Foreign Application Priority Data

Jul. 9, 2015 (FR) ..... 15 56494

(51) Int. Cl.
*F02M 61/20* (2006.01)
*F02M 61/18* (2006.01)
(Continued)

(52) U.S. Cl.
CPC ..... *F02M 61/205* (2013.01); *F02M 47/027* (2013.01); *F02M 61/18* (2013.01);
(Continued)

(58) Field of Classification Search
CPC ..... F02M 61/205; F02M 47/027; F02M 63/0017; F02M 2200/505; F02M 61/18; F02M 61/1806
(Continued)

(56) References Cited

U.S. PATENT DOCUMENTS 3,887,140 A * 6/1975 Hofmann ..... F02M 55/002 239/580
4,092,001 A * 5/1978 Hofmann ..... F02M 61/205 239/533.6
(Continued)

FOREIGN PATENT DOCUMENTS

FR 794839 A 2/1936
JP 2001173536 A 6/2001
WO 9005847 A1 5/1990

*Primary Examiner* — Steven J Ganey
(74) *Attorney, Agent, or Firm* — Joshua M. Haines

(57) ABSTRACT

A coil assembly includes an electric coiling included in an overmold, the coiling being suitable to drive the control valve of a fuel injector. The coil assembly is provided with a longitudinal bore suitable for receiving a spring and with an adjusting member for the setting of the spring which can be moved from outside the injector, the adjusting member forming a transfer of movement such that the movement of the adjusting member from outside the injector is transformed into a compression of the spring.

9 Claims, 3 Drawing Sheets

(51) Int. Cl.
*F02M 47/02* (2006.01)
*F02M 63/00* (2006.01)

(52) U.S. Cl.
CPC .... *F02M 61/1806* (2013.01); *F02M 63/0017* (2013.01); *F02M 2200/505* (2013.01)

(58) Field of Classification Search
USPC ..... 239/5, 465, 533.3, 533.6, 533.8, 533.9, 239/533.11, 533.12, 580
See application file for complete search history.

(56) References Cited

U.S. PATENT DOCUMENTS

| | | | | |
|---|---|---|---|---|
| 4,454,990 | A | 6/1984 | Lewis | |
| 6,269,795 | B1 * | 8/2001 | Ripper ..... | F02M 45/12 239/533.9 |
| 2010/0294243 | A1 | 11/2010 | Ganser et al. | |

* cited by examiner

FUEL INJECTOR HAVING EXTERNAL SETTING OF THE COIL SPRING

CROSS REFERENCE TO RELATED APPLICATIONS

This application is a national stage application under 35 USC 371 of PCT Application No. PCT/EP2016/065206 having an international filing date of Jun. 29, 2016, which is designated in the United States and which claimed the benefit of FR Patent Application No. 1556494 filed on Jul. 9, 2015, the entire disclosures of each are hereby incorporated by reference in their entirety.

TECHNICAL FIELD

The present invention relates to a fuel injector and more particularly an adjusting device for the setting of the valve spring with which it is provided.

TECHNOLOGICAL BACKGROUND OF THE INVENTION

In a fuel injector, a solenoid control valve makes it possible to drive the movements of an injection needle via the variation of the pressure in a control chamber in which the head of the needle is located. When the solenoid valve is powered, it generates a magnetic field which attracts a magnetic core rigidly connected to a control valve slide, thus opening an evacuation channel for the fuel trapped in the control chamber, and, at the end of powering, a compression spring housed in a bore provided in the middle of the solenoid valve pushes back the magnetic core, and the control valve slide closing said evacuation channel again.

The flow of fuel injected each time the solenoid valve is powered is a functional characteristic which is dependent, among other parameters, on the compression of the spring and on the force that it exerts on the magnetic core. Yet, once the injector has been assembled, the compression of the spring is the resultant of dimensions, none of which can be changed: spring length, length of the bore, position of the magnetic core relative to the solenoid valve, etc. The result is a dispersion of said flow characteristic which covers a wide tolerance range which can only be restricted by tightening the manufacturing tolerances of the individual dimensions. However, this possibility has these technical limits, and the width of the current tolerance range is at the expense of improving the production quality of the injectors.

SUMMARY OF THE INVENTION

The aim of the present invention is to overcome the aforementioned disadvantages by proposing a simple and economical solution.

To this end, the invention proposes a coil assembly comprising an electric coiling included in an overmold, the coiling being suitable to drive the control valve of a fuel injector. The coil assembly has a generally elongated revolution-generated cylindrical shape extending along a longitudinal axis from a transverse lower face, suitable for cooperating with a magnetic core, as far as an upper end from which electric connection wires for the coiling extend. The coil assembly is provided with a longitudinal bore opening into the lower face thereof and extending in the middle of the coiling as far as a distant bottom, the bore being suitable for receiving a spring compressed between said bottom and said magnetic core.

Moreover, the coil assembly advantageously comprises an adjusting member for the setting of the spring, said member being suitable to be moved from outside the injector, said movement being transformed into a compression of the spring along the longitudinal axis.

The adjusting member extends along an adjusting axis and comprises a fixed part fixed in the middle of the overmold, and a deformable part arranged such as to block the bottom of the longitudinal bore and cooperate with said spring in order to adjust the setting thereof. The deformable part can be deformed along the longitudinal axis through an action produced from outside the coil assembly.

More particularly, the adjusting member is arranged in an adjusting bore extending radially into the overmold along an adjusting axis substantially which, preferably but not necessarily, is perpendicular to the longitudinal axis. The radial adjusting bore is produced such as to open into the external side face of the overmold, thus an adjusting tool can be engaged therein in order to act upon the deformable part of the adjusting member and adjust the setting of the spring.

Specifically, the fixed part fixed in the overmold is inwardly threaded, and the deformable part blocking the bottom of the longitudinal bore has a peripheral wall that can be deformed along the longitudinal axis when a compression member screwed into the fixed part compresses the deformable part along the adjusting axis, the deformation in the longitudinal direction of the peripheral thinned wall cooperating with the spring. The compression, along the adjusting axis, of the adjusting member produces a radial expansion of the deformable part; since the peripheral wall of the deformable part is thinner than the peripheral wall of the fixed part, said compression produces a deformation by radial expansion of the thin wall, said expansion then being suitable for compressing the spring.

According to another embodiment, the deformable part blocking the bottom of the bore is inwardly beveled, the face joining the exterior to the interior of the deformable part is a female conical face, the apex of which is in the middle of the adjusting member. The compression member bears on the conical face and opens the beveled part increasing the external diameter thereof, said diameter increase being suitable for compressing the spring.

Moreover, a brace is inserted into the radial bore between the deformable part of the adjusting member and the opening of the radial bore in the external side face of the overmold such that the compression member can act upon the deformable part via the brace.

The invention also relates to a fuel injector actuator body having an elongated shape extending from a transverse lower face as far as an upper end; the body being provided with a bore opening into the lower face and extending along the longitudinal axis L as far as a bottom, the bore being suitable for receiving a coil assembly produced according to the preceding paragraphs, the lower face of the coil assembly being flush with the lower face of the actuator body.

Said body is, moreover, provided with a radial hole extending through the wall of the body between an external opening opening into an external face of the body and an internal opening opening into the bore, the radial hole being suitable for the passage of an adjusting tool making it possible to move the adjusting member present in the coil assembly.

The invention also relates to a fuel injector comprising an injector body produced according to the preceding description, and wherein a coil assembly produced according to the preceding paragraphs is arranged, the body being rigidly connected to a control valve and to an injection nozzle.

The invention also relates to a method for adjusting the setting of the coil spring of a fuel injector, the method comprising the steps of:

a) providing a fuel injector, b) arranging the injector on a measuring bench for quantifying, at each injection, the flow of fuel delivered by the nozzle, as a function of the duration for electrically powering the coiling and, c) changing said flow of fuel within a predefined tolerance range by acting by means of an adjusting tool engaged in the radial hole of the injector body, the tool making it possible to move, from outside the injector, the adjusting member for the setting of the spring.

BRIEF DESCRIPTION OF THE DRAWINGS

Other features, aims and advantages of the invention will emerge upon reading the following detailed description, with reference to the appended drawings, given by way of nonlimiting example and wherein.

DESCRIPTION OF THE PREFERRED EMBODIMENTS

Figure 1:
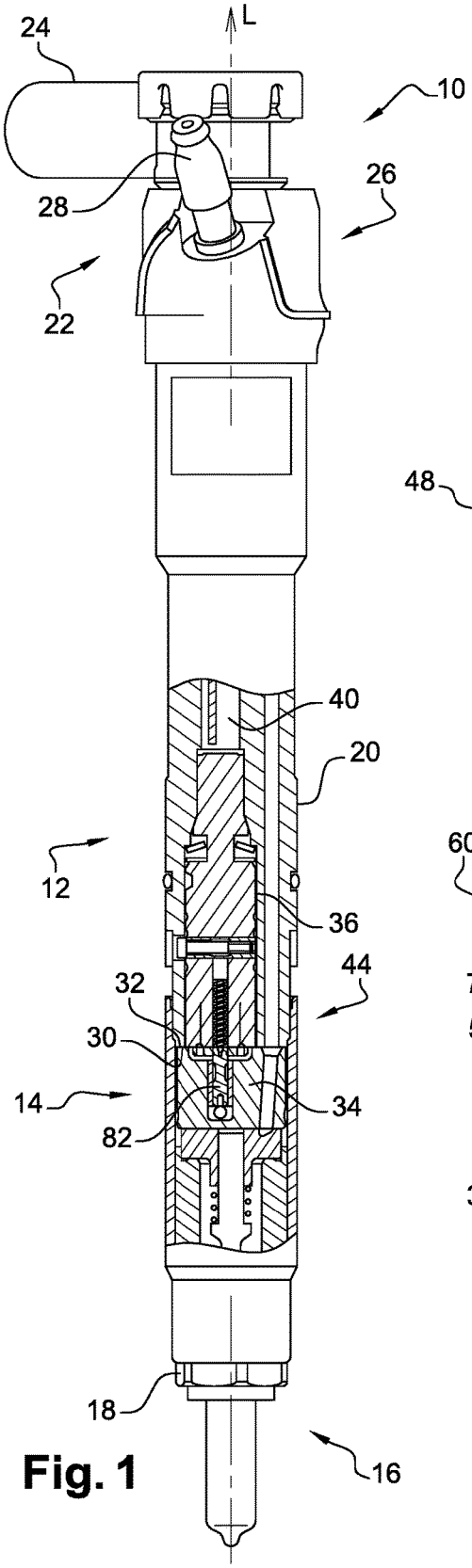
FIG. 1 is a longitudinal section of a fuel injector comprising a means according to the invention for adjusting the setting of the valve spring.

A fuel injector 10, shown in FIG. 1 as a partial section along a longitudinal axis L, comprises, from top to bottom, in the nonlimiting arbitrary direction of the figure, an actuator 12, a control valve 14 and a nozzle 16. The three elements are held such as to be rigidly connected to one another by an injector nut 18 which bears against a shoulder of the nozzle body, closes the valve 12, and is tightly screwed onto the body 20 of the actuator.

The body 20 of the actuator extends from an upper end 22, where an electric connector 24, an inlet mouth 26, and a return mouth 28 for the fuel are arranged, as far as a transverse lower face 30 arranged in tight surface contact against the upper face 32 of the control valve body 34. The actuator body 20 is, moreover, provided with a main bore 36 opening into the lower face 30 and extending along the longitudinal axis L as far as a restricted-section bottom 38 from which extends, as far as the connector 24, a duct 40 in which electric wires 42 are arranged. In the embodiment shown, the main bore 36 extends along an axis that is parallel and slightly offset with respect to the longitudinal axis L, this feature, advantageous particularly for the internal arrangement of the injector, not specifically affecting the present invention.

A coil assembly 44 is placed in the main bore 36, which coil assembly extends from a lower face 46 as far as a top end 48 arranged at the bottom 38 of the bore. The coil assembly 44 comprises a coiling 50 included in an overmold 52, the coiling copper wire being rolled up such that, in the middle of the coiling 50 and of the overmold 52, a longitudinal bore 54 is supplied, commonly called a coil bore, which extends along the longitudinal axis L from the lower face 46 of the coil assembly 44 as far as a bottom 56. The coiling 50 is electrically connected to the connector 24 by a connection module comprising the electric wires 42. The part of the wires 42 which is included in the overmold 52 runs from the coiling 50 as far as the top end 48 of the coil assembly 44, then exits therefrom in order to extend in the duct 40 as far as the connector 24.

The coil assembly 44 is further provided with a radial bore 58 transversely crossing right through the overmold 52 and opening, at two diametrically opposite openings 60, into the sidewall of said overmold, the radial bore 58 being produced at a distance from the lower face 46 of the coil assembly 44, which is substantially equal to the length of the coil longitudinal bore 54 such that the bottom 56 of said longitudinal bore opens perpendicularly at the center of the radial bore 58.

It is obvious that the radial bore 58 does not interfere with the coil 50 nor with the connection electric wires 42 included in the overmold. Conclusive tests have been carried out by "subsequently" producing the bore 58, i.e. by piercing the overmold 52 without touching the copper wires. During production, the radial bore 58 can be produced right at the time of overmolding the coiling 50 either by producing it as a through-bore, or by producing it as a blind-bore then only having a single opening 60.

Figure 2:
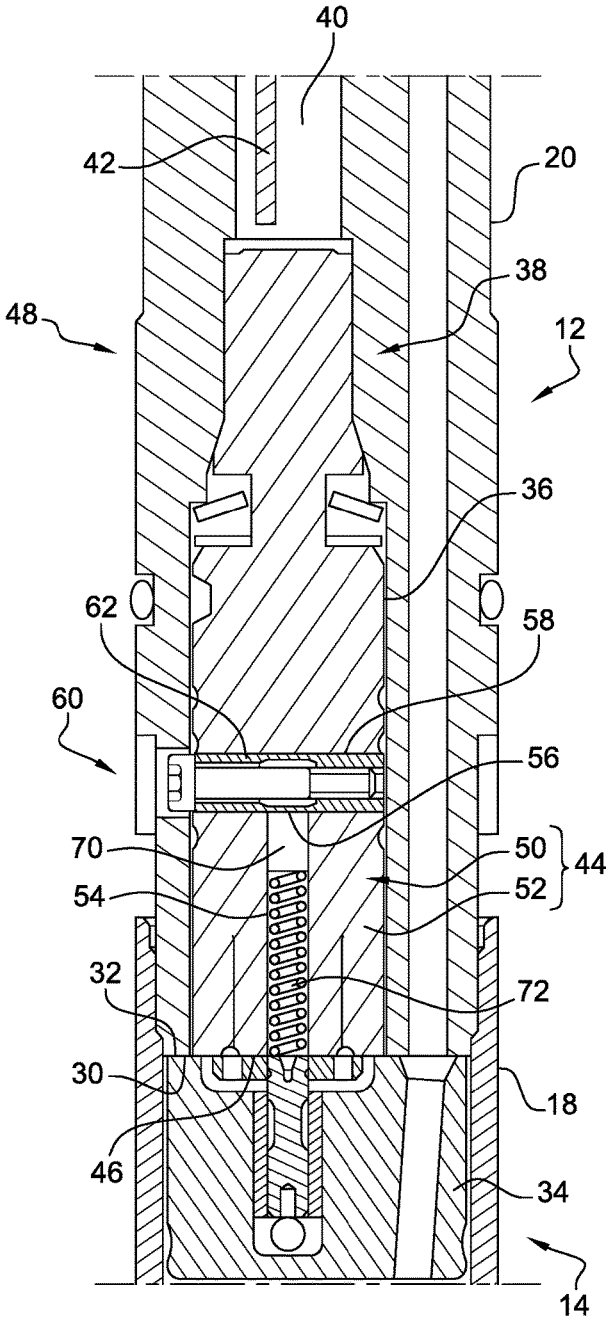
FIG. 2 is a magnified detail of FIG. 1 making it possible to better observe a first embodiment of said adjusting means.
Figure 3:
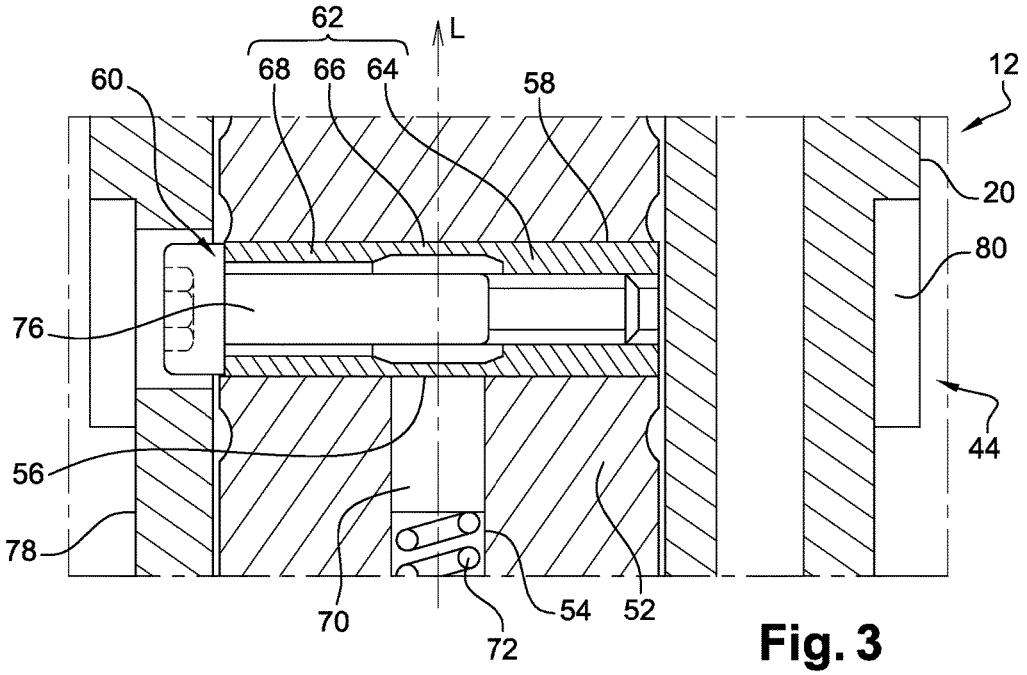
FIG. 3 is a magnified detail of FIG. 2 making it possible to detail the first embodiment of said adjusting means.

An adjusting member 62 is arranged in the radial bore 58, which adjusting member, according to a first embodiment shown in FIGS. 1, 2 and 3, is a revolution-generated cylindrical tubular piece fitted into the radial bore 58, the external diameter of the adjusting member 62 and the diameter of the radial bore 58 being almost identical. The adjusting member 62 has a length substantially equal to that of the bore extending between the two openings 60, or between the bottom of the bore 58, if this is a blind bore, and the single opening 60.

The adjusting member 62 comprises a fixed part 64, arbitrarily shown on the right in the figure, and fixed for example by gluing in the radial bore 58. This fixed part is inwardly threaded and therefore resembles a nut. In the center of the adjusting member 58, the wall is thinned with respect to that of the fixed part 64 with the aim of forming a deformable part 66 with less mechanical strength. Finally, shown on the left of the figure and extending between the deformable part 66 and the opening 60 of the radial bore, the adjusting member 62 comprises a bearing outer part 68, the wall thickness of which is greater than that of the deformable part 66 with the aim of giving the outer part a mechanical strength comparable to that of the fixed part.

As can be seen in the figures, once arranged in the radial bore 58, the deformable part 66 blocks the bottom of the longitudinal bore 54, and the fixed 64 and outer 68 parts extend on either side. Moreover, the embodiment shown in this case is a "single-piece" embodiment in which the three parts 64, 66, 68 of the adjusting member 58 are incorporated in only one piece. In an alternative embodiment, the parts can be separate and are arranged in contact with each other in the radial bore 58. In this "unincorporated" alternative, the fixed part 64 can, for example, be a hexagon nut inserted into an overmolded hexagon housing as of production, the nut no longer needing to be glued, the hexagon shape alone preventing the rotation of the adjusting member 62 in the radial bore 58. Other alternatives make it possible to prevent the rotation of the fixed part 64, thus any noncircular shape such as addition of flat surfaces or, fixing the fixed part using a pin holds the fixed part in place in the radial bore 58.

Arranged perpendicular to the adjusting member 62, in the coil longitudinal bore 54, at the bottom of the bore, are a cylindrical pin 70 in contact with the deformable part 66 of the adjusting member 62, and a valve spring 72, the lower end of which emerges from the longitudinal bore 54 while being flush with the lower face 46 of the coil assembly 44.

The actuator body 20 is, moreover, provided with a radial hole 74 passing through the sidewall thereof and opening on one side into the external side face and on the other side into the bore 36 in which the coil assembly 44 is arranged. This radial hole 74 is produced such that, when the coil assembly 44 is in place in the bore 36 of the valve body, the hole 74 is aligned with the radial bore 58 provided in the overmold 52. Thus, it is possible to access the adjusting member 62 from outside the injector.

As shown, an adjusting screw 76 is engaged in said radial hole 74, at the center of the outer 68 and deformable 66 parts of the adjusting member and is screwed into the fixed member 64. The adjusting screw 76 is screwed until the underside of the screw head comes into contact with the outer part 68 of the adjusting member. In the figures, the screw 76 is of hollow hexagon type but a slotted head or a hexagon head screw is completely permissible, provided that it has a head which bears on the outer part 68.

Moreover, the side face of the actuator body 20 is provided with a threading 78 intended, firstly, for tightening the injector nut 18, however the threading 78 is produced beyond what is strictly necessary for tightening the injector nut 18 and extends over an area that covers the radial hole 74. An inwardly threaded ring 80 is additionally screwed onto the threading 78, thus, by moving by screwing or unscrewing said ring 80, the latter covers or uncovers the radial hole 74 preventing or permitting access, from outside the injector, to the head of the adjusting screw 76. It is therefore important that the adjusting screw 76 has a limited length in order to be able to be entirely housed in the body 20 without protruding at the side surface and without impeding the screwing of the ring 80.

Under the actuator 12, the injector nut 18 firmly holds the control valve 14 and the nozzle 16. A magnetic core and valve slide rigidly connected assembly 82 is arranged in the valve body 34, the valve spring 72 being compressed between the pin 70 and said core-slide assembly 82. When the coiling 50 is powered, it generates a magnetic field which attracts the magnetic core and compresses the spring 72 in the coil bore 54 and, when the powering is cut off, the spring 72 pushes back said assembly 82.

Depending on these longitudinal movements, the valve slide opens or closes an evacuation channel linked to the return mouth 28, these opening/closing operations making it possible to command, indirectly, the injection of fuel.

Injectors are manufactured in series and, at the end of assembly, they are characterized particularly by the measurement of the flow of fuel injected each time the coiling is powered. This characteristic is a function of very many dimensions, particularly the compression of the valve spring 72 and the force that it exerts on the core-slide assembly.

It should be noted that, during manufacturing, the adjusting member 62 is in place in the overmold 52 but the adjusting screw 76 is not yet put in place. A method 100 for adjusting the setting of the spring at the end of the manufacturing cycle is now presented. After the injector nut 18 has been tightened, in order to adjust the setting of the spring, it is necessary to unscrew the threaded ring 80 and thus uncover the radial hole 74. The adjusting screw 76 is then engaged in said hole 74 as well as in the external 68 and deformable 66 parts. It is then screwed into the fixed part 64 of the adjusting member until the screw head is in contact against the outer face of the outer part 68. The injected flow characteristic is measured and can be adjusted by a continuing to screw the adjusting screw 76, and the deformable part 66 of the adjusting member 62 is compressed between the outer part 68 and the fixed part 64. Under the effect of this compression, the thinned wall of the deformable part 66 is deformed by expansion and swells such that the pin is pushed back toward the inside of the longitudinal bore 54, compressing the valve spring 72.

It should be noted that the adjustment can only produce a compression of the spring 72, thus it is important that the manufacturing dimensions and the tolerances thereof are chosen such that the necessary adjustment of the flow characteristic can be achieved by compression of the spring and not by extension.

Conclusive tests have made it possible to identically adjust the flow characteristic of several injectors by compressing, with an M3 screw, an adjusting member 62 made from steel, the deformable part 66 wall of which had a thickness of 0.2 mm. A compression of the spring 72 of a few dozen microns was sufficient and was achieved by tightening the adjusting screw 76 by approximately one turn which is sufficient to achieve a fine adjustment. The small deformation of the deformable part 66 remains largely in the elastic range, thus the adjustment is reversible. Once the adjustment is finished, the ring 80 is then screwed until it covers the radial hole 74, and sealing is also provided by gluing the ring 80 onto the actuator body 20.

Multiple alternatives can stem from the principle which consists in deforming, in the longitudinal direction, an adjusting member included in the injector from outside the injector.

Figure 4:
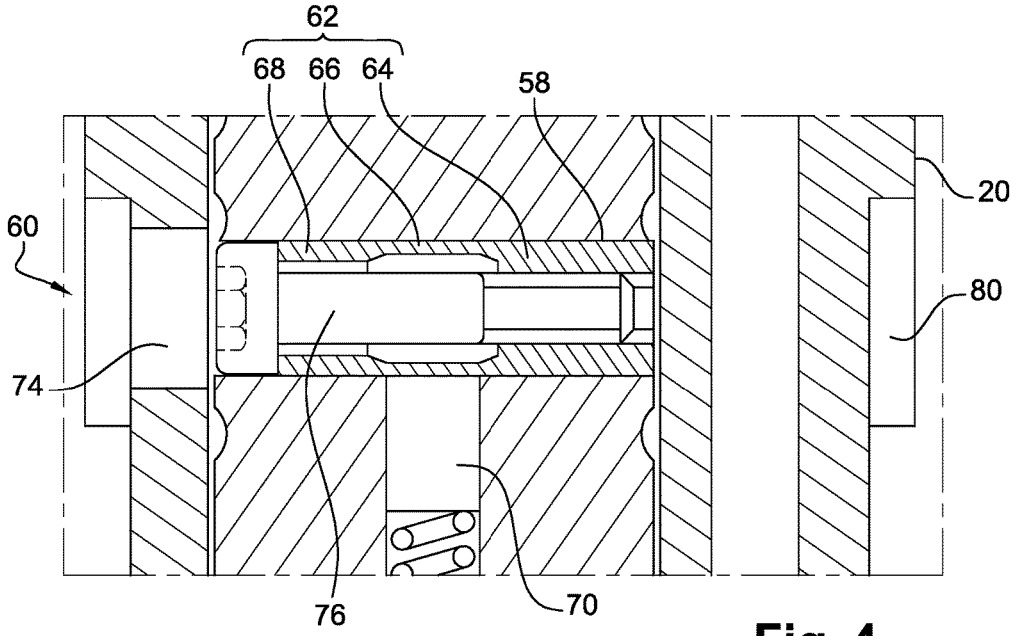
FIG. 4 is an alternative embodiment of the adjusting means of FIG. 3.

In an alternative to the first embodiment, which alternative is shown in FIG. 4, the outer part 68 of the adjusting member is shorter such that the head of the adjusting screw 76 completely enters the radial bore 58. The operation which consists in compressing the deformable part 66 remains identical but, during manufacture, the adjusting screw 76 can be put in place in the coil assembly 44 before the latter is inserted into the injector body 20.

A second embodiment of the adjusting member 62 is now described with reference to FIG. 5. The general principle remains the same but, in this case, the adjusting member 62 comprises two separate parts.

Figure 5:
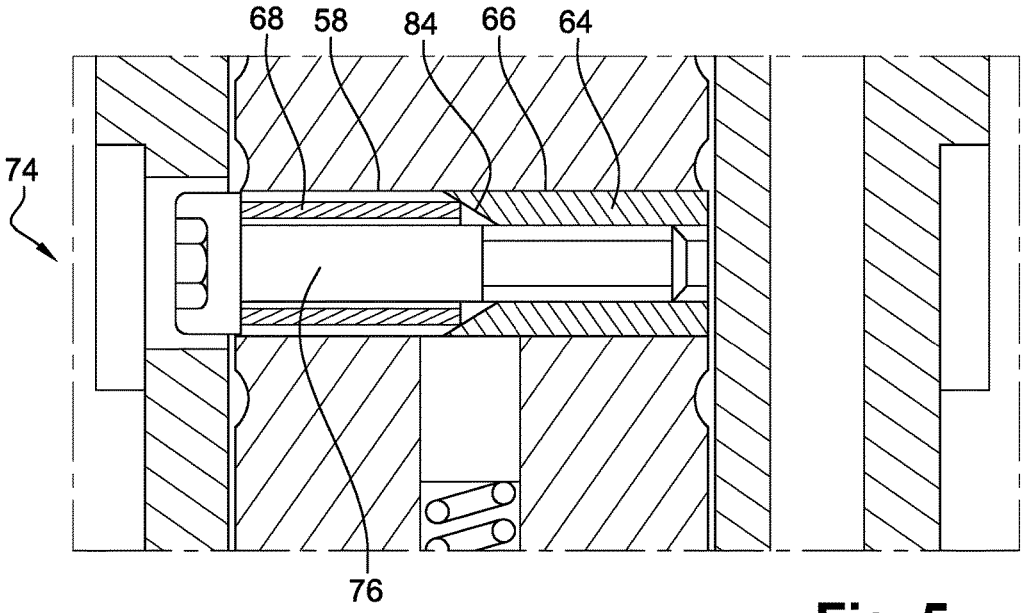
FIG. 5 is a section of a second embodiment of the adjusting means.

Shown on the right in FIG. 5, a first piece incorporates the fixed 64 and deformable 66 parts. This inwardly threaded tubular part is fixed in the radial bore 58 and extends from between an opening 60 of said bore, or from the bottom of the radial bore if the latter is a blind bore, and the center of the bore where this first piece blocks the bottom of the longitudinal bore 54. The end blocking the bottom of the longitudinal bore 54 is the deformable part 66 of the adjusting member 62. It is produced as a bevel, the internal threading being shorter than the external cylindrical face, the face joining said threading to said outer cylindrical face is a female conical face 84, the apex of which is located in the first piece.

The adjusting member 62 comprises a second piece which is, in fact, a tubular strut forming the outer part 68, the strut being in place between the female conical face 84 and the head of the adjusting screw.

By screwing the adjusting screw 76, the strut 68 is forced onto the female conical face 84 with the aim of penetrating the fixed part such that the beveled part with less mechanical strength opens outwardly, this deformation pushing back the pin 70 and compressing the valve spring 72. With the aim of facilitating the opening of the beveled part, it is possible to produce, in the beveled part, one or more slots orientated in the direction of the adjusting axis. In FIG. 5, the face of the strut in contact with the female conical face 84 is an annular planar face, the two faces then being in contact along a circular line defined by the external edge of the strut. Of course, it is possible to shape the end of the strut, for example by beveling it to complement the conical bevel of the deformable part or using any other profile helping the deformation of the beveled part.

Figure 6:
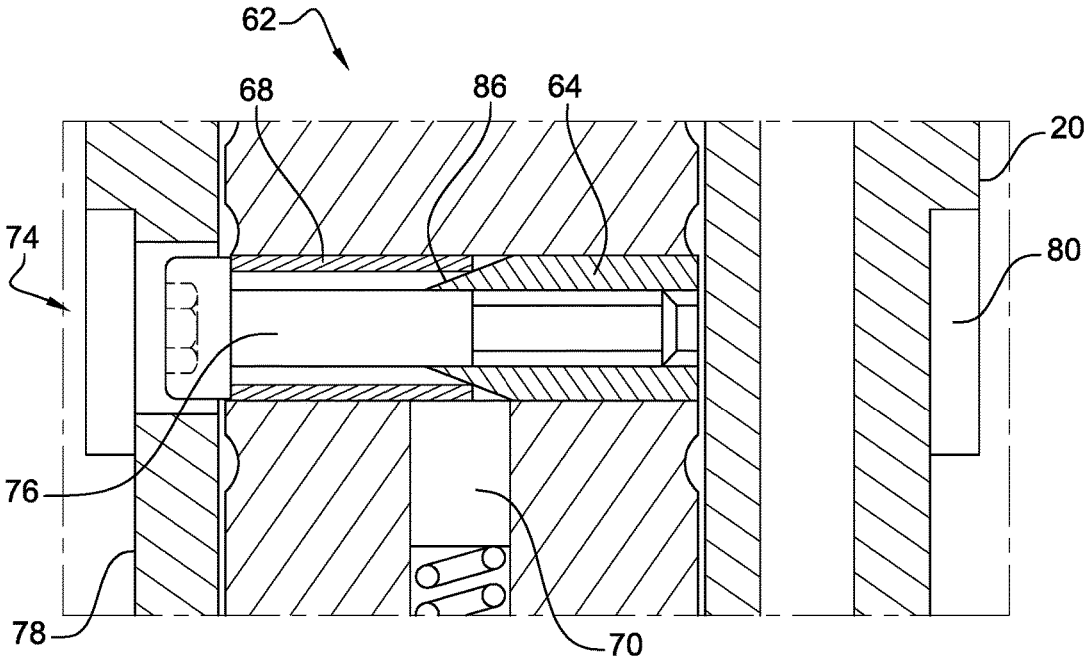
FIG. 6 is a section of a third embodiment of the adjusting means.

A third embodiment shown in FIG. 6, which embodiment is now described, is, in fact, an alternative to the second embodiment, in which alternative the fixed part 64 ends with a male conical face 86, and no longer a female conical face as previously, against which male conical face 86 the strut forming the outer part 68 and the deformable part 66 bears. Under the effect of the compression produced by the adjusting screw 76, the strut is made to open and spread out, pushing back the pin 70 and compressing the valve spring 72. In a manner similar to the second embodiment, with the aim of facilitating the opening of the beveled part, it is also possible to produce, in the strut, one or more slots orientated in the direction of the adjusting axis.

Whether for the second or the third embodiment, the alternative consisting in shortening the outer part in order to make the adjusting screw head enter the radial bore, as shown in FIG. 4, is, of course, possible.

According to an alternative that is not shown, there is nothing to prevent the longitudinal axis from not being perpendicular to the longitudinal axis.

LIST OF USED REFERENCES

L longitudinal axis
10 injector
12 actuator
14 control valve
16 nozzle
18 injector nut
20 actuator body
22 upper end of the actuator member
24 electric connector
26 inlet mouth
28 outlet mouth
30 lower face of the actuator body
32 upper face of the valve body
34 valve body
36 actuator body bore
38 bottom of the bore of the actuator body
40 duct
42 electric wires
44 coil assembly
46 lower face of the coil
48 top end of the coil
50 coiling
52 overmold
54 bore in the middle of the coil
56 bottom of the coil bore
58 radial bore
60 opening of the radial bore in the sidewall of the overmold
62 adjusting member
64 fixed part of the adjusting member
66 deformable part of the adjusting member
68 outer part
70 pin
72 valve spring
74 radial hole in the actuator body
76 adjusting screw
78 threading of the actuator body
80 inwardly threaded ring
82 magnetic core and valve slide assembly
84 female conical face of the second embodiment
86 male conical face of the third embodiment
100 method of adjusting the setting of the spring

The invention claimed is:

1. A fuel injector comprising a coil assembly which comprises:

an electric coiling included in an overmold, the electric coiling being suitable to drive a control valve of the fuel injector, the coil assembly having an elongated revolution-generated cylindrical shape extending along a longitudinal axis from a transverse lower face, suitable for cooperating with a magnetic core, as far as an upper end from which electric connection wires for the electric coiling extend, the coil assembly being provided with a longitudinal bore opening into the transverse lower face thereof and extending in a middle of the electric coiling as far as a distant bottom, the longitudinal bore being suitable for receiving a spring compressed between said distant bottom and said magnetic core, an adjusting member for the setting of the spring, said adjusting member being suitable for movement from outside the fuel injector, said movement being transformed into a compression of the spring along the longitudinal axis and wherein the adjusting member extends along an adjusting axis and comprises a fixed part fixed in a middle of the overmold, and a deformable part arranged such as to block the distant bottom of the longitudinal bore and cooperate with said spring in order to adjust the spring, wherein said deformable part can be deformed along the longitudinal axis through an action produced from outside the coil assembly.

2. The fuel injector as claimed in claim 1, wherein the adjusting member is arranged in an adjusting bore extending radially into the overmold along the adjusting axis substantially perpendicular to the longitudinal axis, the adjusting bore opening into an external side face of the overmold such that an adjusting tool can be engaged therein in order to act upon the deformable part of the adjusting member and thus adjust the spring.

3. The coil assembly as claimed in claim 1, wherein the adjusting member is tubular, the fixed part fixed in the overmold being inwardly threaded, and the deformable part blocking the distant bottom of the longitudinal bore having a peripheral wall that can be deformed along the longitudinal axis when a compression member screwed into the fixed part compresses the deformable part along the adjusting axis, wherein deformation in the longitudinal direction of the peripheral wall of the deformable part cooperates with the spring.

4. The fuel injector as claimed in claim 3, wherein the peripheral wall of the deformable part is thinner than a peripheral wall of the fixed part such that the fixed part compressing the deformable part produces a deformation by expansion of the peripheral wall of the deformable part which compresses the spring.

5. The fuel injector as claimed in claim 3, wherein the deformable part blocking the distant bottom of the longitudinal bore is inwardly beveled, a face of the deformable part joining an exterior of the deformable part to an interior of the deformable part, the face being a female conical face, an apex of which is in the middle of the adjusting member, such that the compression member bears on the face and opens deformable part at the face, thereby increasing an external diameter thereof such that increasing the external diameter results in compressing the spring.

6. The fuel injector according to claim 3, further comprising a brace inserted into the adjusting bore between the deformable part of the adjusting member and an opening of the adjusting bore in the external side face of the overmold such that the compression member acts upon the deformable part via the brace.

7. The fuel injector according to claim 1 further comprising:

a fuel injector actuator body having an elongated shape extending from a transverse lower face as far as an upper end; the fuel injector actuator body being provided with a bore opening into the transverse lower face and extending along the longitudinal axis as far as a bottom, the bore receiving the coil assembly, the transverse lower face of the coil assembly being flush with the transverse lower face of the fuel injector actuator body, said fuel injector actuator body being provided with a radial hole extending through a wall of the fuel injector actuator body between an external opening which opens into an external face of the fuel injector actuator body and an internal opening which opens into the bore, the radial hole being suitable for the passage of an adjusting tool making it possible to move the adjusting member of the coil assembly.

8. A fuel injector as claimed in claim 7 wherein the fuel injector actuator body is rigidly connected to the control valve and to an injection nozzle.

9. A method for adjusting a coil spring of a fuel injector of claim 8, the method comprising the steps of:

a) providing the fuel injector, b) arranging the fuel injector for quantifying, at each injection, the flow of fuel delivered by the injection nozzle of the fuel injector, as a function of the duration for electrically powering the electric coiling of the fuel injector, c) changing said flow of fuel within a predefined tolerance range by acting on the adjusting member through the radial hole of the fuel injector actuator body, thereby adjusting the spring.

* * * * *